US011970876B2

(12) United States Patent
Barnes et al.

(10) Patent No.: US 11,970,876 B2
(45) **Date of Patent: *Apr. 30, 2024**

(54) SHADING SYSTEM AND METHOD OF USE

(71) Applicant: Shibumi Shade, Inc., Raleigh, NC (US)

(72) Inventors: Dane Brooks Barnes, Raleigh, NC (US); Alexander Griffith Slater, Raleigh, NC (US); Scott Christian Barnes, Raleigh, NC (US)

(73) Assignee: Shibumi Shade, Inc., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/072,143

(22) Filed: Nov. 30, 2022

(65) Prior Publication Data

US 2023/0089529 A1 Mar. 23, 2023

Related U.S. Application Data

(63) Continuation of application No. 17/471,658, filed on Sep. 10, 2021, and a continuation of application No.
(Continued)

(51) Int. Cl.
*E04H 15/00* (2006.01)
*E04H 15/30* (2006.01)
(Continued)

(52) U.S. Cl.
CPC ..... *E04H 15/003* (2013.01); *E04H 15/30* (2013.01); *E04H 15/32* (2013.01); *E04H 15/36* (2013.01); *E04H 15/44* (2013.01)

(58) Field of Classification Search
CPC ..... E04H 15/005; E04H 15/60; E04H 15/62
See application file for complete search history.

(56) References Cited

U.S. PATENT DOCUMENTS 1,129,194 A 2/1915 Hanley
1,571,295 A 2/1926 Newman
(Continued)

FOREIGN PATENT DOCUMENTS

AU 200511300 9/2005
AU 2020100586 5/2020
(Continued)

OTHER PUBLICATIONS

"How to Reinforce a Hole in Sunbrella®," webpage <https://www.sailrite.com/How-to-Reinforce-a-Hole-in-Sunbrella>, 1 page, Oct. 16, 2023 (Year: 2023).*
(Continued)

*Primary Examiner* — Noah Chandler Hawk
(74) *Attorney, Agent, or Firm* — Womble Bond Dickinson (US) LLP

(57) ABSTRACT

A system for providing shade onto a surface is described herein. The system includes a canopy configured for engagement with, and aerial suspension by, a frame. The frame includes a plurality of sections configured for end-to-end alignment from a left end to a right end of the frame. Each section is configured to engage with any adjacent sections to form the frame. The ends of the frame are secured to the surface, thereby aerially suspending the canopy and providing shade to the surface.

19 Claims, 8 Drawing Sheets

Related U.S. Application Data

17/343,114, filed on Jun. 9, 2021, now Pat. No. 11,536,046, which is a continuation of application No. 17/232,799, filed on Apr. 16, 2021, said application No. 17/471,658 is a continuation of application No. 17/232,799, filed on Apr. 16, 2021, which is a continuation of application No. 16/987,886, filed on Aug. 7, 2020, now Pat. No. 11,111,690, which is a continuation of application No. 16/224,465, filed on Dec. 18, 2018, now Pat. No. 10,753,117, which is a continuation of application No. 15/675,715, filed on Aug. 12, 2017, now Pat. No. 10,190,330.

(60) Provisional application No. 62/409,426, filed on Oct. 18, 2016.

(51) Int. Cl.

| | |
|---|---|
| ***E04H 15/32*** | (2006.01) |
| ***E04H 15/36*** | (2006.01) |
| ***E04H 15/44*** | (2006.01) |

(56) References Cited

U.S. PATENT DOCUMENTS

| | | | |
|---|---|---|---|
| 2,055,044 | A | 9/1936 | Nelson |
| 2,186,510 | A | 1/1940 | Walter et al. |
| 2,190,566 | A | 2/1940 | Julian |
| 2,193,469 | A | 3/1940 | Ashton |
| 2,554,688 | A | 5/1951 | Vollweiler |
| 2,963,031 | A | 12/1960 | Carroll |
| 3,042,053 | A | 7/1962 | Gabriel |
| 3,051,185 | A | 8/1962 | Reynolds |
| 3,052,249 | A | 9/1962 | Seaman et al. |
| 3,070,107 | A | 12/1962 | Beatty |
| 3,075,536 | A | 1/1963 | Parker |
| 3,165,110 | A | 1/1965 | Brooks |
| 3,190,300 | A | 6/1965 | Wear'n |
| 3,261,134 | A | 7/1966 | Crist |
| 3,286,962 | A | 11/1966 | Warth |
| 3,388,711 | A | 6/1968 | Huddle |
| 3,394,720 | A | 7/1968 | Moss |
| 3,970,096 | A | 7/1976 | Nicolai |
| 4,098,281 | A | 7/1978 | Bonfilio |
| D256,829 | S | 9/1980 | Qui et al. |
| 4,312,371 | A | 1/1982 | Koon |
| D263,984 | S | 4/1982 | Moss |
| 4,404,980 | A | 9/1983 | Wade |
| 4,534,089 | A | 8/1985 | Swan |
| 4,590,956 | A | 5/1986 | Griesenbeck |
| 4,646,770 | A | 3/1987 | Lobato |
| 4,739,784 | A | 4/1988 | Fast |
| 4,750,508 | A | 6/1988 | Tatoian |
| 4,829,694 | A | 5/1989 | Oasheim |
| 4,832,304 | A | 5/1989 | Morgulis |
| 4,915,120 | A | 4/1990 | Ziolkowski |
| 4,924,893 | A | 5/1990 | Furey |
| 4,930,534 | A | 6/1990 | Hill |
| 4,941,422 | A | 7/1990 | Muller |
| 5,046,699 | A | 9/1991 | Perreault et al. |
| D321,924 | S | 11/1991 | Bonner |
| 5,080,123 | A | 1/1992 | Stein |
| 5,215,109 | A | 6/1993 | Kent, Jr. |
| 5,291,640 | A | 3/1994 | Rise |
| 5,299,590 | A | 8/1994 | Deibert et al. |
| 5,358,209 | A | 10/1994 | Ward |
| D363,755 | S | 10/1995 | Diederich |
| 5,546,971 | A | 8/1996 | Leonhardt |
| 5,595,203 | A | 1/1997 | Espinosa |
| 5,678,704 | A | 10/1997 | Deeds |
| 5,690,134 | A | 11/1997 | McCauley |
| D390,730 | S | 2/1998 | Gerhart et al. |
| 5,771,912 | A | 6/1998 | Swetish |
| D397,401 | S | 8/1998 | Diederich |
| D398,363 | S | 9/1998 | LoBue |
| 5,823,217 | A | 10/1998 | Rice |
| D400,949 | S | 11/1998 | Gale |
| 5,927,311 | A | 7/1999 | Jager |
| 5,950,649 | A | 9/1999 | Gerig |
| 6,026,613 | A | 2/2000 | Quiring et al. |
| D421,532 | S | 3/2000 | Koroncai |
| 6,062,243 | A | 5/2000 | Touch et al. |
| D438,929 | S | 3/2001 | Middleton et al. |
| 6,209,149 | B1 | 4/2001 | Song et al. |
| 6,272,695 | B1 | 8/2001 | Brandner |
| 6,276,382 | B1 | 8/2001 | Bindschatel et al. |
| 6,286,531 | B1 * | 9/2001 | Joo-Tai ..... E04H 15/60 135/114 |
| 6,321,861 | B1 | 11/2001 | Leichter |
| 6,402,220 | B2 | 6/2002 | Allen |
| 6,434,891 | B1 | 8/2002 | Cameron |
| 6,964,277 | B2 | 11/2005 | Naber |
| 7,021,866 | B2 | 4/2006 | Keefe |
| 7,191,996 | B2 | 3/2007 | Patsalaridis |
| D544,062 | S | 6/2007 | Baker |
| D555,748 | S | 11/2007 | Gyr et al. |
| 7,316,239 | B2 | 1/2008 | Yang |
| 7,406,977 | B1 | 8/2008 | Shires |
| D577,092 | S | 9/2008 | West |
| D593,315 | S | 6/2009 | Zemel |
| D601,653 | S | 10/2009 | Kirkham, Jr. |
| 7,654,277 | B1 | 2/2010 | Brewer et al. |
| 7,708,339 | B2 | 5/2010 | Zapater |
| 7,721,361 | B1 | 5/2010 | Shubert |
| D624,623 | S | 9/2010 | Viglione |
| 7,789,097 | B1 | 9/2010 | Sotirkys et al. |
| D630,834 | S | 1/2011 | Cohen |
| D638,954 | S | 5/2011 | Nichols |
| 8,424,549 | B1 | 4/2013 | Goldsmith et al. |
| 8,453,664 | B2 | 6/2013 | Parsons et al. |
| 8,720,461 | B2 | 5/2014 | Nichols |
| 8,899,251 | B2 | 12/2014 | Leung et al. |
| 8,991,411 | B1 | 3/2015 | Neuman |
| 9,051,755 | B2 | 6/2015 | Heining et al. |
| 9,051,756 | B1 | 6/2015 | Jenkins |
| 9,103,137 | B2 | 8/2015 | Williams |
| 9,113,724 | B1 | 8/2015 | Heining et al. |
| D739,555 | S | 9/2015 | McAlister |
| D741,437 | S | 10/2015 | Zimmer et al. |
| 9,187,924 | B1 | 11/2015 | Jackson et al. |
| 9,371,641 | B2 | 6/2016 | Christensen et al. |
| D761,372 | S | 7/2016 | Cihal |
| 9,394,719 | B2 | 7/2016 | Choi |
| 9,394,721 | B2 | 7/2016 | Hotes et al. |
| 9,435,133 | B2 | 9/2016 | Bourland |
| 9,447,599 | B1 | 9/2016 | Parent |
| 9,506,268 | B1 | 11/2016 | Bright et al. |
| D788,319 | S | 5/2017 | LeMoine et al. |
| 9,903,134 | B2 * | 2/2018 | Munnerlyn ..... E04H 15/001 |
| D823,419 | S | 7/2018 | Ceccaldi |
| 10,066,417 | B1 | 9/2018 | Linyard et al. |
| D829,839 | S | 10/2018 | Crimi |
| 10,190,330 | B2 | 1/2019 | Barnes et al. |
| D843,200 | S | 3/2019 | Tjerrild |
| 10,252,778 | B1 | 4/2019 | Greer |
| D859,808 | S | 9/2019 | Goldszer |
| D877,486 | S | 3/2020 | Chen |
| 10,602,817 | B2 | 3/2020 | Price |
| D884,816 | S | 5/2020 | Goldberg |
| D928,899 | S | 8/2021 | Zhu |
| 11,156,012 | B2 | 10/2021 | Graham |
| 11,219,286 | B2 | 1/2022 | Cox |
| D947,411 | S | 3/2022 | Climent Bonet et al. |
| D947,975 | S | 4/2022 | Lah |
| D948,653 | S | 4/2022 | Lah |
| D960,277 | S | 8/2022 | Lah |
| 11,634,924 | B2 | 4/2023 | Barnes et al. |
| D989,350 | S | 6/2023 | Barnes et al. |
| D990,605 | S | 6/2023 | Barnes et al. |
| 11,686,120 | B1 | 6/2023 | Yates |
| D993,454 | S | 7/2023 | McKenna et al. |
| D993,455 | S | 7/2023 | McKenna et al. |
| 2003/0066550 | A1 | 4/2003 | Al-Ghamdi |
| 2003/0089390 | A1 | 5/2003 | Seo |

(56) References Cited

U.S. PATENT DOCUMENTS

| | | | |
|---|---|---|---|
| 2007/0079857 | A1 | 4/2007 | Tseng |
| 2007/0295380 | A1 | 12/2007 | Glaeser |
| 2010/0212709 | A1 | 8/2010 | Sotirkys et al. |
| 2012/0291830 | A1 | 11/2012 | Crimi |
| 2013/0074894 | A1 | 3/2013 | Cook |
| 2014/0041703 | A1 | 2/2014 | Funston |
| 2014/0209132 | A1 | 7/2014 | Landry |
| 2015/0040957 | A1 | 2/2015 | Mallookis et al. |
| 2015/0108295 | A1 | 4/2015 | Brooks |
| 2015/0252585 | A1 | 9/2015 | Mallookis et al. |
| 2015/0354244 | A1 | 12/2015 | Gonzalez |
| 2016/0017631 | A1 | 1/2016 | Gilmore |
| 2016/0053508 | A1 | 2/2016 | Gutwenger et al. |
| 2018/0106064 | A1 | 4/2018 | Barnes et al. |
| 2018/0245367 | A1 | 8/2018 | Grieshop |
| 2022/0024290 | A1 | 1/2022 | Howard |
| 2023/0096848 | A1 | 3/2023 | Wang |
| 2023/0126867 | A1 | 4/2023 | Barnes et al. |
| 2023/0151636 | A1 | 5/2023 | Li et al. |

FOREIGN PATENT DOCUMENTS

| | | | | |
|---|---|---|---|---|
| BR | 302019005581 | | 12/2019 | |
| CA | 2524310 | | 4/2006 | |
| CH | 130505 | | 5/2004 | |
| CH | 132260 | | 12/2005 | |
| DE | 10 2009 020 795 | | 11/2010 | |
| FR | 2 884 844 | | 4/2005 | |
| KR | 10-1315166 | | 10/2013 | |
| KR | 101315166 | B1 * | 10/2013 | ..... E04H 15/64 |
| WO | WO 82/03317 | | 10/1982 | |
| WO | WO 02/04768 | | 1/2002 | |
| WO | WO 2011/012969 | A2 | 2/2011 | |
| WO | WO 2020/089599 | | 5/2020 | |
| WO | WO 2022/174316 | | 8/2022 | |

OTHER PUBLICATIONS

Machine Translation of KR101315166B1, retrieved from EPO Nov. 23, 2021 (Year: 2021).*

YouTube video by Robert Marazzita: The Best Beach Cabana—Set Up and Tear Down, Jul. 9, 2015, [site visited Aug. 8, 2017], Available on the Internet URL: <https:www.youtube.com/watch?v=LfccH7yV6SE>.

YouTube video by Robb's Homemade Life: Make $15 Beach Shade tent Easy Quick DIY, Oct. 6, 2015 [site visited Aug. 8, 2017] Available on the internet URL: <www.youtube.com/watch?v+X20b4pLJx1c>.

YouTube video by Beachspirit: Kitent (R)—the Floating beach tent for sun shade, Oct. 8, 2016 [site visited Aug. 8, 2017] Available on the internet URL: <https://m.youtube.com/watch?v=OUaDZeqdTkQ>.

YouTube video by Ziggy Shade Beach Sunshade: Ziggy Shade—Beach Sunshade—Set up instructions, Nov. 24, 2016 [site visited Aug. 8, 2017] Available on the internet URL: <https://youtu.be/1krQ0rlumws>.

YouTube video by bibitedog: How to set up a butterfly arch, May 26, 2012 [site visited Dec. 18, 2018] Available on the internet URL: <https://www.youtube.com/watch?v=FOTYtjQAL4s>.

Suniela Beach Portable Shade Cabanas, [site visited Oct. 21, 2021], Available on the internet URL: <https://suniela.com>.

Solbello Shade Training Video, YouTube, Apr. 20, 2023, https://www.youtube.com/watch?v=wd3XV9hADZc.

"No Wind Kit for Beach Shades," Upgrade Your Shade, https://www.upgradeyourshade.com/product/upgrade-your-shade-kit Retrieved 2023.

Shibumi Shade, posted Oct. 12, 2018 [online], [retrieved Jan. 19, 2023], Retrieved from internet, https://www.facebook.com/shibumishade/ (Year: 2018).

* cited by examiner

SHADING SYSTEM AND METHOD OF USE

CROSS-REFERENCE TO RELATED APPLICATIONS

This application is a continuation of U.S. application Ser. No. 17/471,658, filed Sep. 10, 2021, and a continuation of U.S. application Ser. No. 17/343,114, filed Jun. 9, 2021, which is a continuation of U.S. application Ser. No. 17/232,799, filed Apr. 16, 2021, which is a continuation of U.S. application Ser. No. 16/987,886, filed Aug. 7, 2020, which granted Sep. 7, 2021 as U.S. Pat. No. 11,111,690, which is a continuation of U.S. patent Ser. No. 16/224,465, filed Dec. 18, 2018, which granted Aug. 25, 2020 as U.S. Pat. No. 10,753,117, which is a continuation of U.S. application Ser. No. 15/675,715, filed Aug. 12, 2017, which granted Jan. 29, 2019 as U.S. Pat. No. 10,190,330, which is a non-provisional of U.S. Provisional Patent Application 62/409,426 filed Oct. 18, 2016, which applications are hereby incorporated by reference in their entirety in this application.

TECHNICAL FIELD

The presently disclosed subject matter is directed towards a system and method for providing shade from the sun. Specifically, a transportable system and method of use for providing shade from the sun is disclosed that includes a canopy supported by a singular frame and an engaged counterweight.

BACKGROUND

Avoiding direct sunlight when outdoors is a ubiquitous problem faced by anyone who spends significant time outdoors. Shading systems of the prior art are typically ineffective or impractical to use for a number of reasons. Some systems include rigid canopy susceptible to being shifted or unanchored by wind. Other systems are cumbersome to transport or assemble, due to the number of parts involved, steps required during setup and/or low shade to weight ratios.

Accordingly, there remains a need for systems and methods including flexible canopy structures capable of being at least partially supported by wind and configured for easy of transport and assembly.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

According to at least one embodiment of the disclosed subject matter, a system for providing shade onto a surface is provided. The system includes a canopy configured for engagement with, and aerial suspension by, a frame; the frame consisting essentially of a plurality of sections configured for end-to-end alignment from a left end to a right end, wherein each section is configured to engage with any adjacent sections, wherein the left end and the right end are configured to be secured to the surface for aerially suspending the frame and the canopy.

According to at least one embodiment of the disclosed subject matter, a method of providing shade to a surface is provided. The method includes coupling adjacent sections of a plurality of sections into end-to-end alignment to form a frame from a first end to a second end; sliding the frame through one or more loops of a canopy; securing the left end and the right end of the frame to the surface, thereby aerially suspending the canopy and providing shade to the surface.

According to at least one embodiment of the disclosed subject matter, the system further includes a cable extending through the plurality of sections of the frame from the left end to the right end.

According to at least one embodiment of the disclosed subject matter, the system further includes a cord coupled to an anchor and engageable with, or coupled to, the canopy or frame, the anchor configured for housing weight.

According to at least one embodiment of the disclosed subject matter, the system further includes at least one loop on a suspension end of the canopy, the loop configured for accepting a portion of the frame therethrough.

According to at least one embodiment of the disclosed subject matter, wherein the canopy further includes at least one hoop positioned at an apex of the suspension end engageable with, or coupled to, a cord, the cord engageable with, or couple to, an anchor for housing weight.

According to at least one embodiment of the disclosed subject matter, the system further includes at least one strap engageable with the canopy and configured to wrap about the frame for securing the canopy into position relative to the frame.

According to at least one embodiment of the disclosed subject matter, wherein the at least one strap includes a strap fastener on one end configured for fastening to a canopy fastener on the other end for securing the canopy into the position relative to the frame.

According to at least one embodiment of the disclosed subject matter, wherein the at least one strap has a higher friction of coefficient with respect to the frame relative to the canopy with respect to the frame.

According to at least one embodiment of the disclosed subject matter, wherein the at least one strap is elastic.

According to at least one embodiment of the disclosed subject matter, wherein all but one of the sections includes a female end for accepting a male end of one of the adjacent sections therein.

According to at least one embodiment of the disclosed subject matter, the system further includes a container for housing and transporting all of the other components of the system.

According to at least one embodiment of the disclosed subject matter, wherein the container is also an anchor for housing weight, the container coupled to a cord, the cord engageable with, or coupled to, the canopy or frame.

According to at least one embodiment of the disclosed subject matter, wherein the cord is attached to an interior bottom of the container for inverting the container to serve as the anchor for housing weight.

According to at least one embodiment of the disclosed subject matter, wherein the container includes an interior compartment for housing the sections separate from the canopy.

According to at least one embodiment of the disclosed subject matter, the method further includes filling an anchor with weight, the anchor selectively engageable with, or secured to, the canopy or the frame via a cord.

According to at least one embodiment of the disclosed subject matter, wherein coupling adjacent sections includes a receiving end of all but one of the sections accepting one of the adjacent sections therein.

According to at least one embodiment of the disclosed subject matter, the method further includes unpacking the frame and the canopy from a container configured for transporting the frame and the canopy.

According to at least one embodiment of the disclosed subject matter, the method further includes wrapping at least one strap engaged with the canopy about the frame for securing the canopy into position relative to the frame.

According to at least one embodiment of the disclosed subject matter, the method further includes fastening the at least one strap for locking the strap into position.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

DETAILED DESCRIPTION

Figure 1:
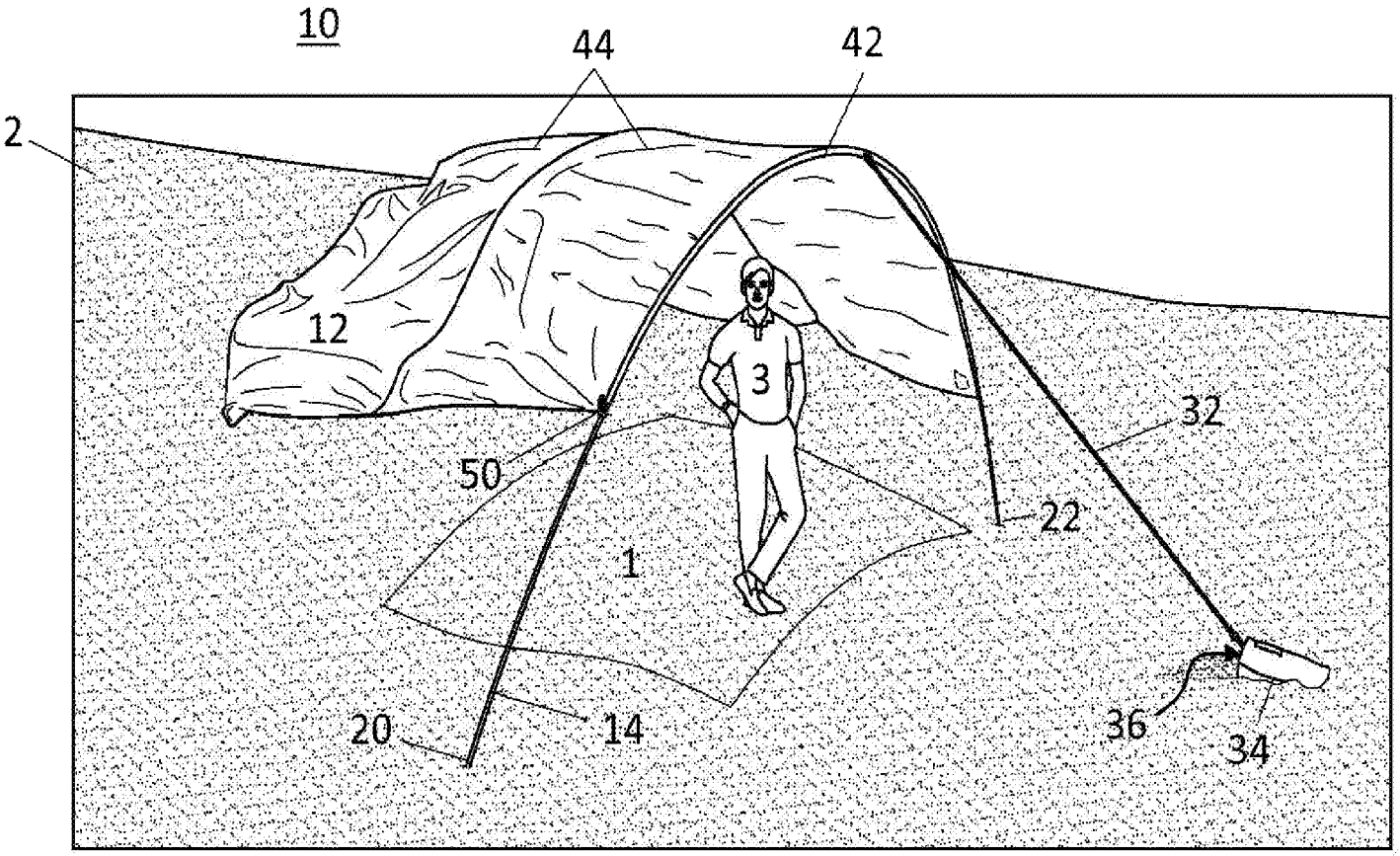
FIG. 1 is a perspective view of a system for providing shade according to one or more embodiments of the presently disclosed subject matter.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

FIG. 1 depicts one embodiment of a system 10 for providing shade 1 onto a surface 2. The system 10 may include a canopy 12 configured for engagement with, and aerial suspension by, a frame 14. The canopy 12 may include one or more lightweight materials, the material including one or more of the following properties: ripstop, polyester, blackout, light diffusion, light modification, and waterproof. The canopy 12 may be unitarily constructed or may include a plurality of coupled sections 44 and/or selectively engageable sections 44.

According to some embodiments, the canopy 12 may define a suspension end 42 positioned proximal to the frame 14 when the canopy 12 is engaged with the frame 14. The suspension end 42 may include one or more suspension fasteners 46 for engaging the canopy 12 with the frame 14. Fasteners 46, 52, 54, as used herein, may include any fasteners of the prior art, including but not limited to hooks and loops, male and female buttons, hook and slit or aperture, and/or magnets. FIG. 1 depicts the canopy 12 defining at least one loop 40 on the suspension end 42 of the canopy, the loop 40 configured for accepting a portion 26 of the frame 14 therethrough. Although the loop 40 of FIG. 1 extends the entire length of the suspension end 42, the loop 40, or plurality of loops 40, may only extend a smaller distance of the suspension end 42. In some embodiments, one or more loops 40 may include tie strings for engaging the suspension end 42 with the frame 14.

The canopy 12 may be configured to suspend or be stored in any number of shapes and sizes. In some embodiments, the canopy 12 may define one or more vent holes and/or wind socks for permitting wind to pass therethrough. In other embodiments, the canopy 12 may define tails extending from a side opposite the suspension end 42.

Figure 3:
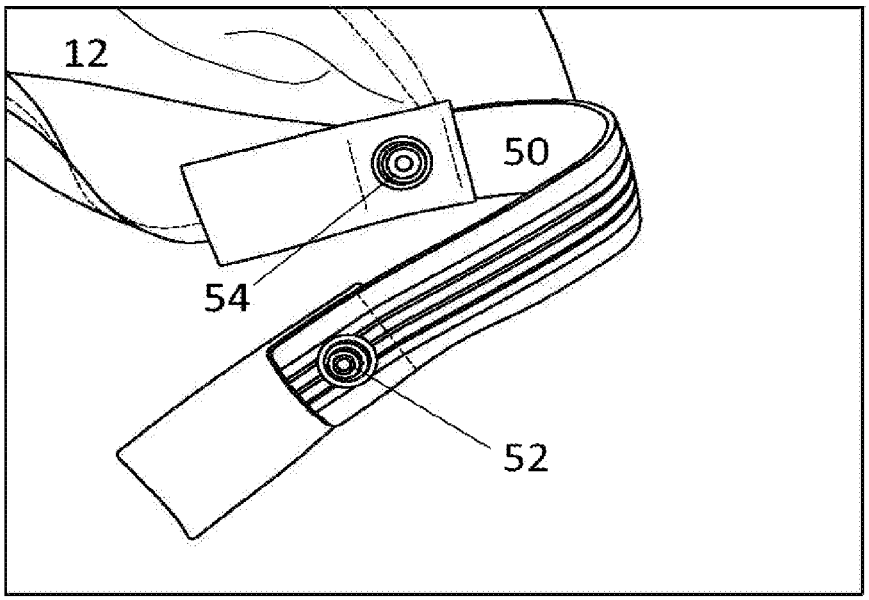
FIG. 3 is a perspective view of at least one strap engageable with a canopy according to one or more embodiments of the presently disclosed subject matter.

While the suspension end 42, suspension fasteners 46 and loop(s) 40 engage the canopy 12 to the frame 14, in some embodiments, additional securing mechanisms may be desired to secure the canopy 12 into position relative to the frame 14. FIGS. 1 and 3 depict embodiments of the system 10 including at least one strap 50 engageable with, or coupled to, the canopy 12 for securing the canopy 12 into position relative to the frame 14. The at least one strap 50 may be elastic rubber, gear ties, bungee cord, rope or any other material capable of wrapping about the frame 14 or other component of the system 10. The at least one strap 50 may engage or couple to the canopy 12 on either or both ends of the suspension end 42 and/or to the loop 40 of the suspension end 42. Each of the straps 50 may be configured to wrap about the frame 14, or engage the frame 14 using a strap fastener 52 and/or a canopy or frame fastener 54. In some embodiments, a strap 50 may include a canopy fastener 54 for engaging the canopy 12 (e.g., a ball at one end of the strap 50 for engaging a grommeted aperture of the canopy 12), and the strap 50 may be manipulated about the frame 14. Alternatively, a strap 50 may include both a strap fastener 52 on one end and a canopy fastener 54 on the other end for wrapping the strap 50 about the frame 14 and fastening the fasteners 52, 54 together (see, e.g., FIG. 3). In yet another alternative, the strap 50 may include be coupled or engaged to the canopy 12 on one end and include a frame fastener 54 on the other end for engaging the canopy 12 to the frame 14.

The at least one strap 50 may be comprised of any number of materials, including but not limited to one or more of the following: fabric, rubber, plastic, and metal. In some embodiments, the at least one strap 50 may have a higher friction of coefficient with respect to the frame 14 relative to the canopy 12 with respect to the frame 14. For example, if the canopy 12 includes polyester fabric and the at least one strap 50 includes rubber, then the friction of coefficient with a metal or plastic frame 14 would be higher for the strap than for the canopy 12. In some embodiments, the at least one strap 50 may be elastic. Being able to stretch the at least one strap 50 about the frame 14 when engaging the strap 50 thereto can greatly increase the friction between the strap 50 and the frame 14, particularly if the strap 50 is also fastened to itself after wrapping.

Figure 2:
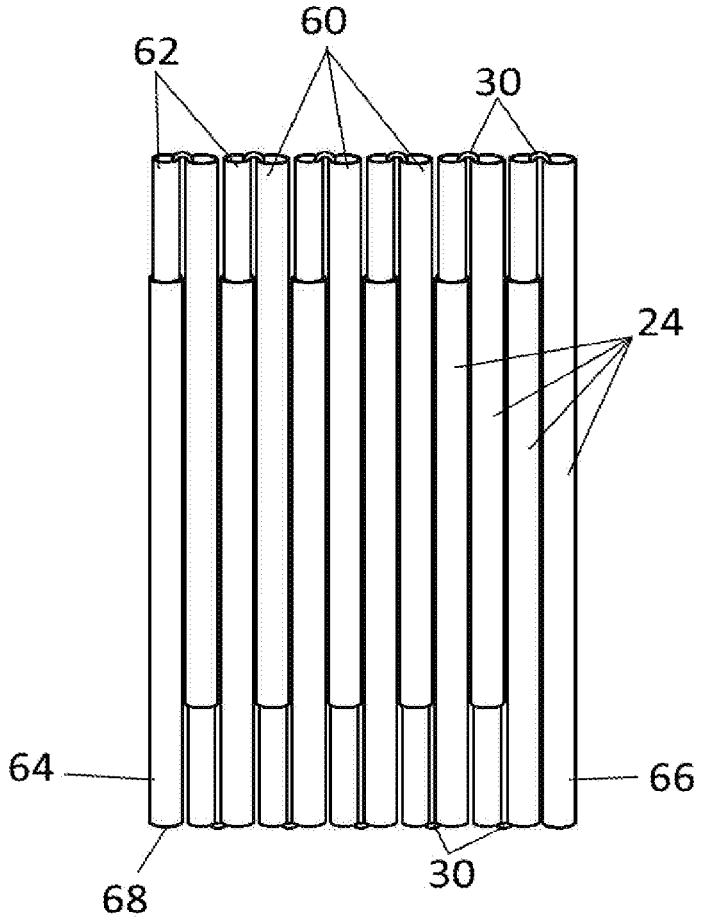
FIG. 2 is a front view of a frame in a transport configuration according to one or more embodiments of the presently disclosed subject matter.

According to some embodiments, the frame 14 of the system 10 may include, or consist essentially of, a plurality of sections 24 configured for end-to-end alignment from a left end 20 of the frame 14 to a right end 22 of the frame 14. Each of the sections 24 may be further configured to engage with any adjacent sections 24. When two or more or all of the sections 24 are aligned end-to-end and engaged with adjacent sections 24, the sections 24 being an example embodiment of an aligning component, the frame 14 may be positioned to receive and support the canopy 12. In some embodiments, the sections 24 are arranged telescopically, where each adjacent section 24 may be housed within, and extend from each adjacent section 24. In other embodiments, as depicted in FIG. 2, many of the sections include both a male end 62 and a female end 60 for engaging adjacent sections 24 to each other to construct the supporting frame 14. In some embodiments, all but one of the sections 24 includes a female end 60 for accepting a male end 62 of one of the adjacent sections 24 therein.

During transport, the sections 24 may be compactly configured as depicted in FIG. 2. A first section 64 may define the left end 20 of the frame 14 and a last section 66 may define the right end 22 of the frame 14. The first section 64 may include a single male end 62 or female end 60, with the other end being the left end 20 and/or cap 68 (FIG. 2 depicts first section 64 having a male end 62 and cap 68). A last section 66 may similarly include a single male end 62 or female end 60, with the other end being the right end 22 and/or cap 68 (FIG. 2 depicts last section 66 having a female end 60 and cap 68). The cap may serve to close off an end of the first and/or last section 64, 66 for preventing sand from entering therein and for securing the cable 30, as described below.

As depicted in FIG. 2, the system 10 may further include a cable 30 extending through the plurality of sections 24 of the frame 12 from the left end 20 to the right end 22. The cable 30 may be elastic so that the sections 24 may be maneuvered between a transport configuration (e.g., FIG. 2) and a supporting configuration (e.g., FIG. 1), yet still remain adjacent and aligned end-to-end, the cable 30 being an example of an aligning component by providing supporting tension to the end-to-end alignment of the supporting configuration. The cable 30 may be affixed to an interior and/or cap 68 of the first section 64 and second section 66. The cable 30 may also be affixed to interiors of any of the other sections 24.

When the frame 14 is in the transport configuration, and a cable 30 extends through the sections 24 of the frame 14, the male and female ends 60, 62, and/or the cable 30 itself, may be configured to prevent degradation or injury to the cable 30. Looking to FIG. 2, any pressure applied to the sections 24 from the top of the figure or the bottom of the figure may create injury to the cable 30 where it is exposed between the male and female ends 60, 62. Therefore, the female ends 60 and/or male ends 62 may define grooves for permitting passage of the cable therebetween such that any objects applying pressure from the top or bottom of the figure would apply that pressure directly to the ends 60, 62 and not onto the cable 30, effectively clipping the cable between the end 60, 62 and the object. The cable 30 may include reinforcements at the exposed sections between the ends 60, 62 when in the transport configuration. The reinforcements may include additional layers of fabric, metal-reinforced cylinders, and/or thicker elastic bands.

In some embodiments of the system 10, the sections 24 of the frame 12 may form a curved shape when in the supporting configuration. In other embodiments, the sections 24 may form other shapes or designs when in the supporting configuration. A curved shape may be formed when the male and female ends 60, 62 are co-extensive with curved axis the remaining portions of the sections 24. To form other designs, the female ends 60 and/or male ends 62 may be shaped for creating non-co-extensive angles with respect to the axis of the remaining portions of the sections 24. For example, a female end 60 engaging two sections may be shaped in a right angle, thereby creating an 'L' shape when the two adjacent sections are engaged. Other female ends 60 may be shaped at other angles, thereby creating a design or pattern when all of the sections 24 are engaged and the frame is in the supporting configuration.

Figure 4:
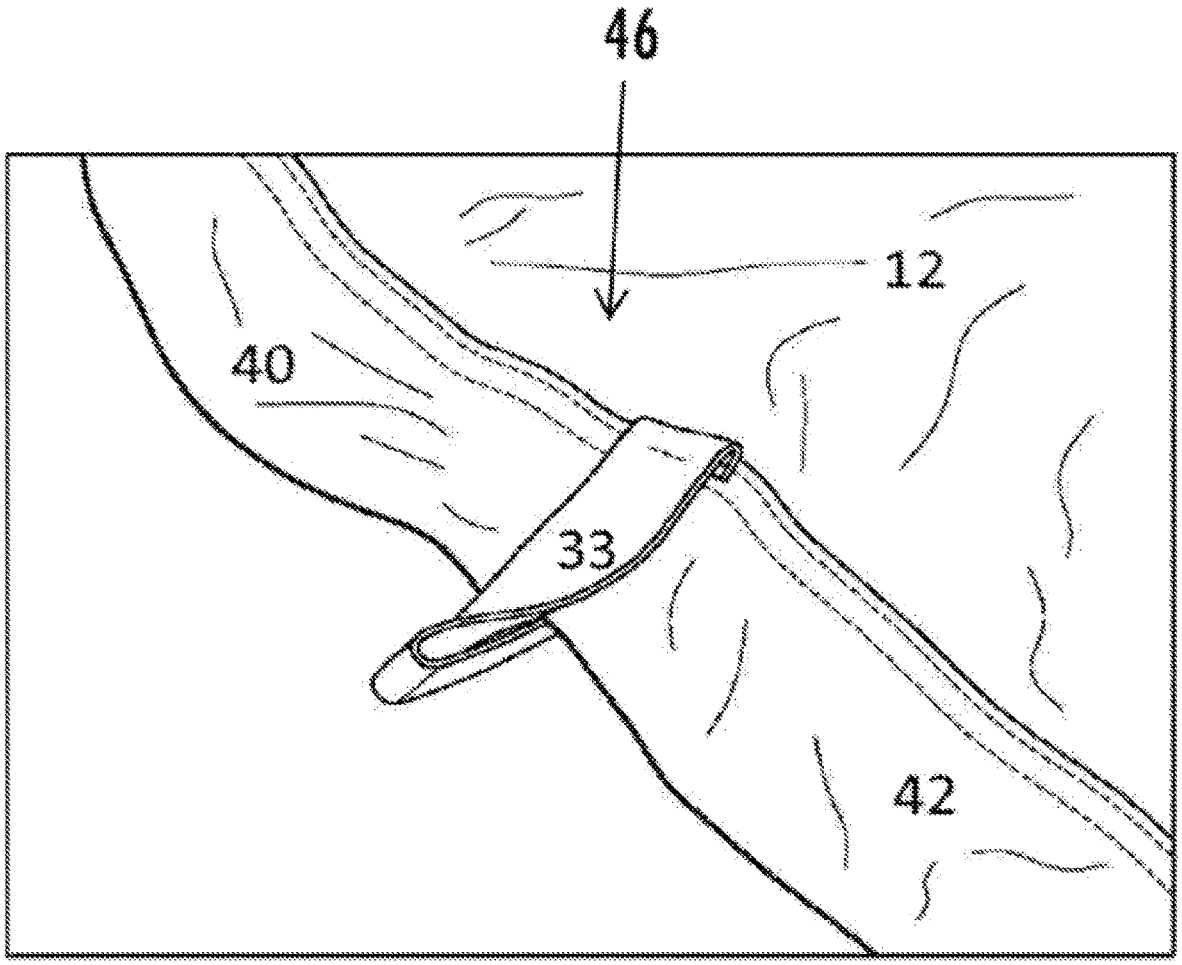
FIG. 4 is a perspective view of a loop coupled to the canopy for engaging a cord according to one or more embodiments of the presently disclosed subject matter.
Figure 5:
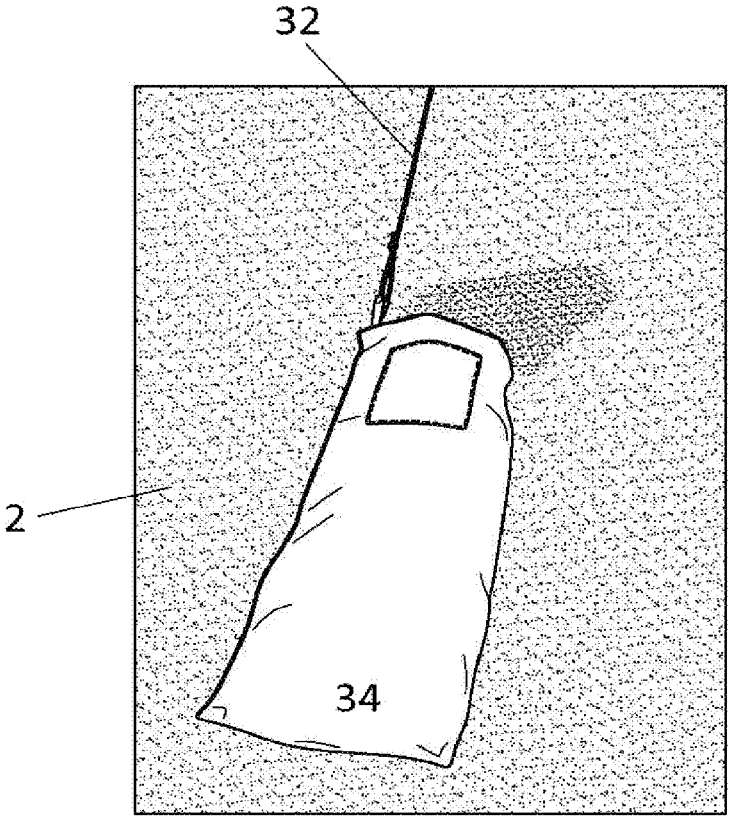
FIG. 5 is a perspective view of a container serving as an anchor according to one or more embodiments of the presently disclosed subject matter.

Referencing FIGS. 4 and 5, the system 10 may further include a cord 32 engaged with, or coupled to, an anchor 34, the canopy 12, and/or the frame 14 for providing support to the frame 14 when in the supporting configuration. The anchor 34 may be configured for housing weight 36. The cord 32 may be engaged with or coupled to the canopy 12 and/or frame 14 at an apex of the canopy 12 and/or frame 14. For example, if the ends 20, 22 of the frame 14 are secured within sand on a beach, the anchor 34 may be filled with sand acting as the weight 36. The system 10 may further include a hoop 33 or other fastener, such as the fasteners described herein, engaged with, or coupled to, the canopy 12 or frame 14 with which the cord 12 may be engaged or coupled (e.g., see FIG. 4 embodiment where the hoop 33 is coupled to the canopy 12).

Figure 6:
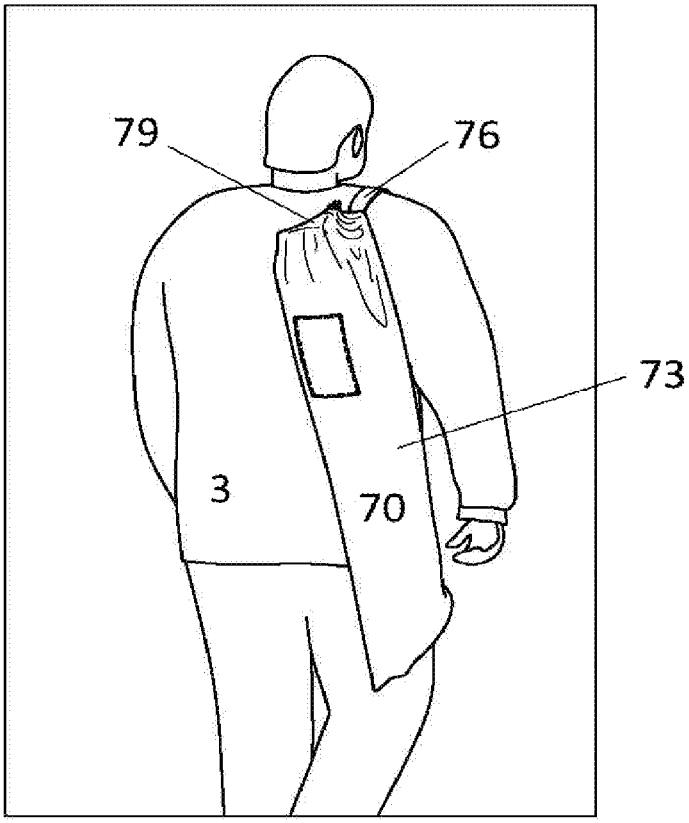
FIG. 6 is a perspective view of the container housing the system for shading according to one or more embodiments of the presently disclosed subject matter.

FIG. 6 depicts an embodiment of the system 10 further including a container 70 for housing and transporting all of the other components of the system 10. The container 70 may include a band 76 for transporting the container 70 about the shoulder or in the palm of a user 3. The band 76 may be configured to be a handle and/or may be selectively engageable with the container 70 for storage therein. The container 70 may include a drawstring 78 or other closing mechanism for securing the contents of the system 10 therewithin.

The container 70 may also be the anchor 34 for housing weight 36 (see, e.g., FIG. 5). In some embodiments, the container 70 may be inverted for housing weight 36 for ensuring that minimal amounts of weight 36 remain in the container once re-inverted so that the contents of the system 10 are not disturbed by any weight 36 during transportation and/or storage of the system 10. The cord 32 may be engaged with or coupled to an interior 72 of the container 70 for inverting the container 70. The cord 32 may be engaged with or coupled to the bottom 74 of the container 70 for permitting full inversion, or at a mid-point 75 of the container 70 for permitting half inversion of the container 70 (see, e.g., FIG. 7). In other embodiments, the cord 32 may be selectively engaged or coupled with an exterior 73 of the container 70.

For example, when the contents of the system 10 are removed from the container 70, the cord 32 may be pulled away from the container 70 while the container 70 is held into position (or pushed away from the cord 32), thereby inverting the container 70 to serve as the anchor 34. When the cord 32 is engaged or coupled to an interior 72 and bottom 74, the pulling of the cord 32 may result in the full inversion of the container 70. When the cord is engaged or coupled to an interior 72 and mid-point 75, the pulling of the cord 32 may result in a half inversion of the container 70. If the container 70 includes a compartment 77 as described herein, then the inversion of the container 70 may result in the compartment 77 being exterior to the anchor 34 and any weight 36.

Figure 7:
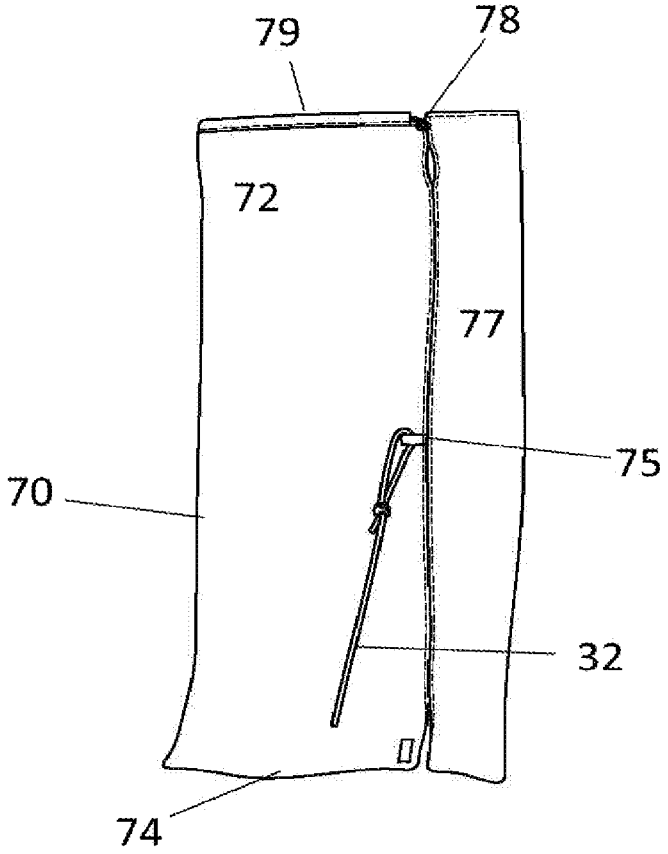
FIG. 7 is a perspective view of the container having a compartment for housing sections of the frame according to one or more embodiments of the presently disclosed subject matter.

FIG. 7 illustrates the container 70 including a compartment 77 positioned on the interior 72 for housing the sections 24 separate from the canopy 12. The compartment 77 may be engageable with or coupled to the interior 72 of the container 70. The compartment 77 may be sewn to the interior 72 of the container 70 along a single seam or multiple seams. A drawstring or other closing mechanism 78 may be included on the container 70 for cinching close an open side 79 of the container. Although FIG. 7 depicts the seam of the compartment 77 only connecting a portion of the compartment length to the container 70, other embodiments may include the entire length of the compartment 77 being sewn to the container 70.

Figure 8:
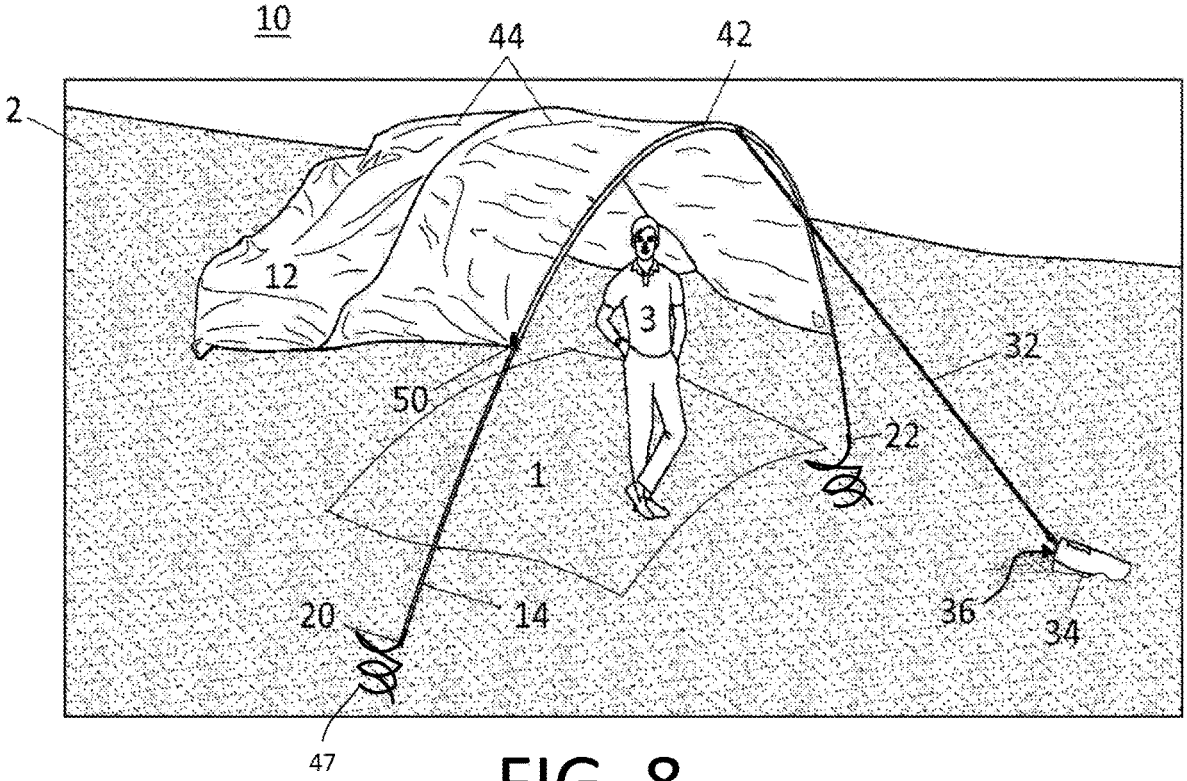
FIG. 8 is a perspective view of a system for providing shade according to one or more embodiments of the presently disclosed subject matter.

The left end 20 and the right end 22 of the frame 14 may be each be embedded in the surface 2. As shown in FIG. 8, the ends 20, 22 may define a conical shape or a corkscrew shape 47 for ease of penetration of the surface 2. Additional anchor(s) 35 may be engaged or coupled to the left end 20 and/or right end 22 for further securing the frame 14 into position. In embodiments where a tail is defined by the canopy 12, the tail may be engaged with or coupled to an additional anchor 34 for securing the canopy 12 into position for providing shade 1 to the surface 2. In yet additional embodiments, an additional suspension end 43 may be defined by the canopy 12. The additional suspension end 43 may include any of the features and characteristics described herein attributed to the suspension end 42. For example, the additional suspension end 43 may form an additional loop 41 for engaging or coupling an additional frame 15, thereby further suspending the canopy 12 from both the frame 14 and the additional frame 15.

In addition to the methods of using the system 10 described herein, the following additional methods of using the system 10 are provided. A method of providing shade 1 to a surface 2 may include unpacking or removing the frame 14 and the canopy 12 from the container 70. Adjacent sections 24 of the plurality of sections 24 may be engaged or coupled into end-to-end alignment to configure the frame 14 from a left end 20 to a right end 22 into a supporting configuration. The frame 14 may slide through one or more loops 40 of the canopy 12 and/or may be engaged with the suspension end 42 of the canopy 12. The ends 20, 22 of the frame 14 may be secured to the surface 2, thereby aerially suspending the canopy 12 and providing shade 1 to the surface 2.

The canopy 12 may be secured into position relative to the frame 14 by wrapping at least one strap 50 about the frame 14 and/or fastening the at least one strap 50 to or about the frame 14. The cord may be engaged with the canopy 12, frame 14 and/or anchor 34. The anchor 34 may be filled with weight 36. Additional anchors 35 may be engaged with the ends 20, 22, additional frame 15 and/or tail of the canopy 12. The additional anchors 35 may be filled with weight 36.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

The invention claimed is:

1. A system for providing shade onto a surface, the system comprising:

a frame including a plurality of sections and being maneuverable between a transport configuration and a supporting configuration, the sections including:

a first section defining a left end of the frame engaged with the surface;

a last section defining a right end of the frame engaged with the surface; and one or more adjacent sections coupled into alignment and engaged between the first section and the last section, the one or more adjacent sections additionally comprising at least one aligning component affixed to one or more of the adjacent sections of the frame and providing supporting tension to the alignment in the supporting configuration and allowing the one or more adjacent sections to be maneuvered between the transport configuration and the supporting configuration, the adjacent sections being configured to engage between the first section and the last section in the supporting configuration;

a canopy extending between a first end and an second end, the first end of the canopy defining a suspension end capable of being engaged with the frame about the one or more adjacent sections of the frame, wherein the second end of the canopy defines a trailing end spaced apart from the frame in the supporting configuration such that the first end of the canopy is supportable by the frame and the trailing end of the canopy is totally supported by wind in a first configuration for providing shade to the surface; and a loop on the suspension end of the canopy and configured for accepting a portion of the frame therethrough for engaging the canopy with the frame, the loop being the only fastener securing the canopy into position relative to the frame.

2. The system of claim 1, wherein the canopy is a unitary sheet of material or comprises a plurality of sheets of material coupleable together.

3. The system of claim 2, wherein the plurality of sheets of material are selectively engageable sections.

4. The system of claim of claim 1, wherein the canopy has at least one set of parallel sides.

5. The system of claim 1, wherein the canopy comprises one or more vent holes defined within the canopy, one or more tails extending therefrom, one or more wind socks, or a combination thereof.

6. The system of claim 1, wherein the one or more adjacent sections of the frame comprises a plurality of longitudinally-extending sections.

7. The system of claim 1, wherein the at least one aligning component comprises a cable extending through and affixed to the one or more adjacent sections of the frame of the frame.

8. The system of claim 1, wherein the frame is directly engageable with the surface.

9. The system of claim 1, further comprising a cord having a first end and a second end, the first end or the second end of the cord being coupleable to the frame or the canopy.

10. The system of claim 9, further comprising an anchor coupleable to the other of the second end or the first end of the cord and being in contact with the surface so that the frame remains engaged with the surface when the wind is applied to the canopy.

11. The system of claim 1, further comprising a container capable of housing and transporting the components of the system therein as well as acting as a counterweight that is coupleable to one or both of the frame and the canopy, and engageable with the surface to retain the frame in the supporting configuration.

12. The system of claim 1, wherein the left end of the frame has a corkscrew shape and the right end of the frame has a corkscrew shape.

13. A system for providing shade onto a surface, the system comprising:

a frame defined by a plurality of sections and comprising an aligning component extending through at least a portion of the sections, each of the plurality of sections having one or both of a male end and a female end making the plurality of sections thereby engageable with at least one adjacent section to define the frame in a supporting configuration and thereby disengageable to define the frame in a transport configuration; and a canopy defining one or more sections extending between a first end forming a suspension end of the canopy and a second end forming an opposing trailing end of the canopy, the suspension end of the canopy including only a single fastener that engages the canopy with the frame and that secures the canopy in position relative to the frame, wherein the trailing end of the canopy is spaced apart from the frame in the supporting configuration such that the canopy is supportable by the frame and the trailing end is totally supported by wind in a first configuration for providing shade to the surface, wherein the single fastener comprises a loop.

14. The system of claim 13, wherein the canopy is unitarily constructed or comprises a plurality of coupled sections.

15. The system of claim 13, wherein the canopy defines one or more vent holes, one or more tails extending from a side opposite the suspension end, one or more wind socks, or a combination thereof.

16. The system of claim 13, further comprising a container capable of housing and transporting the components of the system therein as well as acting as a counterweight that is coupleable to one or both of the frame and the canopy, and engageable with the surface to retain the frame in the supporting configuration.

17. The system of claim 13, wherein the aligning component comprises a cable.

18. The system of claim 13, wherein the left end of the frame has a corkscrew shape and the right end of the frame has a corkscrew shape.

19. The system of claim 13, further comprising a container capable of housing and transporting the components of the system.

* * * * *